US007665805B2

(12) United States Patent
Ueda

(10) Patent No.: US 7,665,805 B2
(45) Date of Patent: Feb. 23, 2010

(54) CHAIR

(75) Inventor: Nobuyuki Ueda, Osaka (JP)

(73) Assignee: Kokuyo Furniture Co., Ltd., Osaka-shi (JP)

( * ) Notice: Subject to any disclaimer, the term of this patent is extended or adjusted under 35 U.S.C. 154(b) by 393 days.

(21) Appl. No.: 11/594,835

(22) Filed: Nov. 9, 2006

(65) Prior Publication Data

US 2007/0108822 A1 May 17, 2007

(30) Foreign Application Priority Data

Nov. 11, 2005 (JP) ..... 2005-328164

(51) Int. Cl.
*A47C 1/024* (2006.01)

(52) U.S. Cl. ..... 297/301.6; 297/301.1; 297/301.5; 297/303.1; 297/307

(58) Field of Classification Search ..... 297/271, 297/295, 301.1, 301.6, 301.5, 303.1, 307
See application file for complete search history.

(56) References Cited

U.S. PATENT DOCUMENTS

| | | | | |
|---|---|---|---|---|
| 293,813 | A | 2/1884 | St. John | |
| 2,083,838 | A | 6/1937 | Goenen et al. | |
| 2,538,507 | A | 1/1951 | Cramer | |
| 3,133,763 | A | 5/1964 | Stoll et al. | |
| 3,938,858 | A * | 2/1976 | Drabert et al. | 297/284.4 |
| 4,090,700 | A | 5/1978 | Davis | |
| 4,549,764 | A | 10/1985 | Haedo | |
| 4,575,150 | A | 3/1986 | Smith | |
| 4,640,548 | A | 2/1987 | Desanta | |
| 4,709,963 | A | 12/1987 | Uecker et al. | |
| 4,830,430 | A * | 5/1989 | Schafer | 297/298 |
| 4,834,453 | A | 5/1989 | Makiol | |
| 4,869,552 | A | 9/1989 | Tolleson et al. | |

(Continued)

FOREIGN PATENT DOCUMENTS

DE 199 30 922 A1 5/2000

(Continued)

OTHER PUBLICATIONS

European Office Action dated Mar. 29, 2007, Application No. 06123872.1-1258.

(Continued)

*Primary Examiner*—Laurie K Cranmer
(74) *Attorney, Agent, or Firm*—Westerman, Hattori, Daniels & Adrian, LLP

(57) ABSTRACT

It is a subject to provide a chair capable of realizing a condition in which movements of a seating person are preferably followed and a condition in which a back of the seating person can be preferably supported. For this purpose, a chair C comprising a lower frame portion that is supported to be rockable between a standing position and a rearward tilting position of a back frame with respect to the base and an upper frame portion that is supported to be rockable between a normal position and a rear end position, wherein the chair is further comprised with a movement range setting mechanism with which a movement range through the rocking movement of the upper frame portion with respect to the lower frame portion is made changeable in accordance with the position of the lower frame portion with respect to the base during the rocking movement.

20 Claims, 18 Drawing Sheets

U.S. PATENT DOCUMENTS

| | | | | |
|---|---|---|---|---|
| 5,046,780 | A | 9/1991 | Decker et al. | |
| 5,172,930 | A | 12/1992 | Boye et al. | |
| 5,249,839 | A | 10/1993 | Faiks et al. | |
| 5,348,372 | A | 9/1994 | Takamatsu et al. | |
| 5,385,388 | A | 1/1995 | Faiks et al. | |
| 5,649,739 | A | 7/1997 | Zapf | |
| 5,904,397 | A | 5/1999 | Fismen | |
| 5,951,109 | A | 9/1999 | Roslund, Jr. et al. | |
| 5,988,746 | A | 11/1999 | Raftery | |
| 6,050,646 | A | 4/2000 | Stenzel et al. | |
| 6,056,361 | A | 5/2000 | Cvek | |
| 6,086,153 | A * | 7/2000 | Heidmann et al. | 297/300.1 |
| 6,116,687 | A | 9/2000 | Vogtherr | |
| 6,149,236 | A | 11/2000 | Bräuning | |
| 6,189,971 | B1 | 2/2001 | Witzig | |
| 6,220,661 | B1 | 4/2001 | Peterson | |
| 6,257,665 | B1 | 7/2001 | Nagamitsu et al. | |
| 6,406,096 | B1 | 6/2002 | Barile, Sr. | |
| 6,439,661 | B1 | 8/2002 | Bräuning | |
| 6,460,928 | B2 | 10/2002 | Knoblock et al. | |
| 6,517,156 | B1 | 2/2003 | Lin | |
| 6,523,898 | B1 * | 2/2003 | Ball et al. | 297/320 |
| 6,565,153 | B2 * | 5/2003 | Hensel et al. | 297/285 |
| 6,572,190 | B2 | 6/2003 | Koepke et al. | |
| 6,609,755 | B2 * | 8/2003 | Koepke et al. | 297/300.2 |
| 6,672,669 | B2 | 1/2004 | Chu et al. | |
| 6,695,403 | B1 | 2/2004 | Su | |
| 6,695,404 | B2 * | 2/2004 | Bruske | 297/316 |
| 6,729,688 | B2 | 5/2004 | Erne | |
| 6,761,406 | B2 * | 7/2004 | Kinoshita et al. | 297/296 |
| D497,264 | S * | 10/2004 | Aubriet et al. | D6/366 |
| 6,811,215 | B2 | 11/2004 | Horiki et al. | |
| 6,843,530 | B1 | 1/2005 | Wu | |
| 6,913,316 | B2 * | 7/2005 | Kinoshita et al. | 297/300.3 |
| 6,991,291 | B2 | 1/2006 | Knoblock et al. | |
| 7,014,269 | B2 | 3/2006 | Coffield et al. | |
| 7,066,537 | B2 | 6/2006 | Coffield et al. | |
| 7,118,176 | B2 | 10/2006 | Erker | |
| 7,134,722 | B2 * | 11/2006 | Ueda et al. | 297/301.1 |
| 7,226,127 | B1 | 6/2007 | Yevko et al. | |
| 7,273,253 | B2 | 9/2007 | Deimen et al. | |
| 7,396,079 | B2 * | 7/2008 | Heidmann et al. | 297/285 |
| 7,422,287 | B2 * | 9/2008 | Heidmann et al. | 297/354.1 |
| 7,434,879 | B2 * | 10/2008 | Ueda et al. | 297/296 |
| 2002/0117883 | A1 | 8/2002 | Gevaert | |
| 2002/0180248 | A1 * | 12/2002 | Kinoshita et al. | 297/284.1 |
| 2002/0180250 | A1 | 12/2002 | Kinoshita et al. | |
| 2002/0180252 | A1 * | 12/2002 | Kinoshita et al. | 297/463.1 |
| 2002/0190553 | A1 | 12/2002 | Koepke et al. | |
| 2002/0190555 | A1 | 12/2002 | Holbrook et al. | |
| 2003/0127896 | A1 | 7/2003 | Deimen et al. | |
| 2004/0012237 | A1 * | 1/2004 | Horiki et al. | 297/440.11 |
| 2004/0140701 | A1 | 7/2004 | Schmitz et al. | |
| 2004/0183350 | A1 | 9/2004 | Schmitz et al. | |
| 2007/0108819 | A1 | 5/2007 | Ueda | |
| 2007/0108820 | A1 | 5/2007 | Ueda | |
| 2007/0108821 | A1 | 5/2007 | Ueda | |
| 2007/0108831 | A1 | 5/2007 | Ueda | |
| 2008/0030059 | A1 * | 2/2008 | Deimen et al. | 297/354.11 |

FOREIGN PATENT DOCUMENTS

| | | | |
|---|---|---|---|
| DE | 101 47 021 | A1 | 4/2003 |
| EP | 0 259 609 | A2 | 3/1988 |
| EP | 0 552 388 | A1 | 7/1993 |
| EP | 1 447 029 | A1 | 8/2004 |
| FR | 2627968 | | 9/1989 |
| GB | 610741 | | 10/1948 |
| GB | 2 143 730 | A | 2/1985 |
| JP | 61041028 | A | 2/1986 |
| JP | 2616332 | B2 | 6/1997 |
| JP | 2002-119373 | A | 4/2002 |
| JP | 2002-119375 | A | 4/2002 |
| JP | 2003-265256 | A | 9/2003 |
| NL | 7 804 978 | A | 11/1978 |
| WO | WO 86/02243 | A1 | 4/1986 |
| WO | WO 94/27472 | A1 | 12/1994 |
| WO | WO 00/22961 | A1 | 4/2000 |

OTHER PUBLICATIONS

European Search Report dated Jan. 30, 2007 issued in corresponding European Application No. 06 12 3875 of co-pending U.S. Appl. No. 11/594,836.

European Search Report dated Feb. 1, 2007, issued in corresponding application EP 06 12 3869 of co-pending U.S. Appl. No. 11/594,837.

European Search Report mailed Mar. 12, 2007, issued in corresponding application EP 06 12 3874 of co-pending U.S. Appl. No. 11/594,834.

European Search Report dated Apr. 16, 2007 issued in corresponding EP Application No. 06123876.2-1258 of co-pending U.S. Appl. No. 11/594,858.

* cited by examiner

CHAIR

BACKGROUND OF THE INVENTION

1. Field of the Invention

The present invention relates to a chair which a backrest can be inclined backwards.

2. Description of the Related Art

A chair which a backrest surface is arranged by bridging an upholstery member between frame elements that comprise a pair on the right and left sides is conventionally disclosed. For instance, there is disclosed a chair arranged in that an upper portion of the backrest surface is supported by an upper frame element while a lower portion of the backrest surface is supported by the lower frame element, wherein each of the upper frame element and the lower frame element is individually made to perform rotating operations around a horizontal axis, that is, rocking operations (see, for instance, Japanese Patent Laid-Open Publication No. 2002-119375 and Japanese Patent Laid-Open Publication No. 2002-119373). With this arrangement, such chairs realize the backrest surface that suits trunks or backbone shapes of individual seating persons and that further might follow movements of upper bodies of seating persons.

Incidentally, when a person takes seat on a chair in a condition in which the upper body is erected, the person often turns back, reaches his or her hand or twists his or her body. The chairs according to the above-mentioned patent documents were arranged in that they followed movements of the upper body, and particularly the upper portion of a seating person by rocking the upper frame element with respect to such movements of the seating person.

However, when the seating person inclines his or her upper body backwards, the backrest is required to reliably support the upper body of the seating portion. More particularly, when the upper frame element of the backrest is movable in accordance with movements of the upper body of the seating person as discussed above, it will in turn be impossible to support the upper portion of the upper body in a stable manner. Such an arrangement will cause a drawback in that the seating person might feel unstable when he or she inclines his or her upper body to incline the lower frame element of the backrest backward.

SUMMARY OF THE INVENTION

The present invention has been made in view of the above problems, and it is to provide a chair that realizes both of a condition in which movements of a seating person can be preferably followed and a condition in which the back of the seating person can be preferably supported.

The present invention has implemented the following means for achieving such an object. More particularly, the chair according to the present invention comprises at least a leg body, a base supported by the leg body, and a back frame supported by the base, the back frame comprising a lower frame portion that is supported to be rockable between a standing position and a rearward tilting position with respect to the base and an upper frame portion that is supported to be rockable between a normal position and a rear end position with respect to the lower frame portion, wherein the chair is further comprised with a movement range setting mechanism with which a movement range through the rocking movement of the upper frame portion with respect to the lower frame portion is made changeable in accordance with the position of the lower frame portion with respect to the base during the rocking movement.

Here, both an aspect in which the movement range of the upper frame portion becomes larger and an aspect in which the movement range of the upper frame portion becomes smaller with the lower frame portion inclining backwards are included.

With such an arrangement, it is possible to set the movement range of the upper frame portion to meet the posture of a seating person, and particularly a posture of the upper body. More particularly, where it is desired to make the shape of the backrest of the chair follow movements of the upper body of a seating person, the movement range of the upper frame portion can be set large while when the backrest is required to support the upper body of the seating person, the movement range of the upper frame portion can be set small. As a result, it is possible to provide a chair having a backrest that is capable of exhibiting functions as desired by a seating person.

For achieving an arrangement in which movements of the upper body are not prevented when the upper body of a seating person is upright as well as an arrangement with which the upper frame portion can preferably support the upper body of the seating person when the upper body is inclining backwards, a movement range setting mechanism is desirably arranged in that the movement range of the upper frame portion is set to become narrower in accordance with the lower frame portion coming closer to the rearward tilting position. Here, the reduced movement range also includes an aspect in which the backrest is immovably fixed.

For obtaining an arrangement in which the upper body of a seating person can be preferably inclined backwards when the lower frame is inclined backwards, the movement range setting mechanism is desirably arranged in that the rear end position of the upper frame is made to come closer to a normal position with the lower frame portion coming closer to the rearward tilting position. Moreover, a more preferable arrangement in which the upper body of a seating person is stably supported with the lower frame portion being inclined backwards, the movement range setting mechanism might prohibit movements of the upper frame portion at any position of the lower frame portion during which it is backwardly inclining from the standing position to the rearward tilting position. Here, as for the position of the lower frame at which movements of the upper frame portion is prohibited, it is possible to employ an aspect in which movements of the upper frame when the position of the lower frame portion is at any position in the course of reaching from a slightly rearward tilting position from the standing position up to the rearward tilting position, is prohibited.

As a concrete arrangement of changing the movable range of the upper frame portion in accordance with the rearward tilting position of the lower frame portion with the thus arranged movement range setting mechanism, it is desirable to arrange a regulating member, which prohibits movement of the upper frame portion upon abutting the upper frame portion when the upper frame portion is positioned at the rear end position, to tentatively come closer to the normal position of the upper frame portion in accordance with the rearward tilting movement of the lower frame portion. Further, as a concrete arrangement of prohibiting movements of the upper frame at any position of the backward inclining lower frame portion, the above-mentioned regulating member is preferably made to abut the upper frame portion at any position of the lower frame portion during which it is backwardly inclining from the standing position to the rearward tilting position. For arranging the regulating member to preferably correspond to the movements of the lower frame, the regulating member is desirably supported by the base.

For achieving an arrangement in which the upper body of a seating person is supported in a more stable manner when inclining the lower frame portion backward by setting the movement range narrower while setting the elastically biasing force strong, it is desirable to further comprise an upper frame portion elastically biasing means that elastically biases the upper frame from the rear end position to the normal position, wherein elastically biasing force of the upper frame portion elastically biasing means is set to be larger with the lower frame portion coming closer to the rearward tilting position. While as a concrete arrangement of the upper frame portion elastically biasing means, an embodiment in which the upper frame portion elastically biasing means is comprised by an elastic member provided between the upper frame portion and the lower frame and an aspect in which it is comprised by an elastic member provided between the base and the upper frame portion might be listed, it is possible to realize such an arrangement by simply mounting the elastic member with the latter arrangement.

Such an elastic member might be preferably realized by employing a frame-like spring.

Here, the term "frame-like" indicates an aspect in which it faces along the frame that comprises an object of mounting or one in which it extends along the frame. Further, a "frame-like spring" might be a resin spring formed into a frame-like shape or one obtained by cutting a spring steel plate in a frame-like shape. It might of course also be a spring steel plate treated with resin-type coating.

By employing the frame-like spring and by arranging the same to face along other frame elements that comprise the back frame portion, the entire chair can be arranged in a compact manner. Particularly in case a "frame-like" spring corresponding to the shape of the frame elements is employed, it is possible to arrange an upper frame portion elastically biasing means that is indistinctive as an entire chair. Moreover, with a frame-like spring, it is possible to arrange an elastic member that exhibits preferable elastically biasing force also in the above-mentioned case in which it is provided between the base and the upper frame portion that are remote from each other with the lower frame portion being interposed between.

For achieving an arrangement in which it is possible to switch between ON/OFF of the movement range setting mechanism upon at the request of a seating person, it is preferable to provide a switching mechanism for temporally terminating functions of the movement range setting mechanism.

For arranging a backrest that is capable of truly following movements of the upper body of a seating person, the upper frame portion is arranged to include a pair of upper frame elements disposed on the right and left, this pair of upper frame elements being supported to be rockable with respect to the lower frame portion in a mutually independent manner between a normal position and a rear end position.

According to the present invention, where it is desired to make the shape of the backrest of the chair follow movements of the upper body of a seating person, the movement range of the upper frame portion can be set larger while when it is desired to make the backrest support the upper body of the seating person, the movement range of the upper frame portion can be set narrower. As a result, it is possible to provide a chair having a backrest capable of achieving functions that are in accordance with postures of a seating person.

DESCRIPTION OF THE PREFERRED EMBODIMENTS

Figure 1:
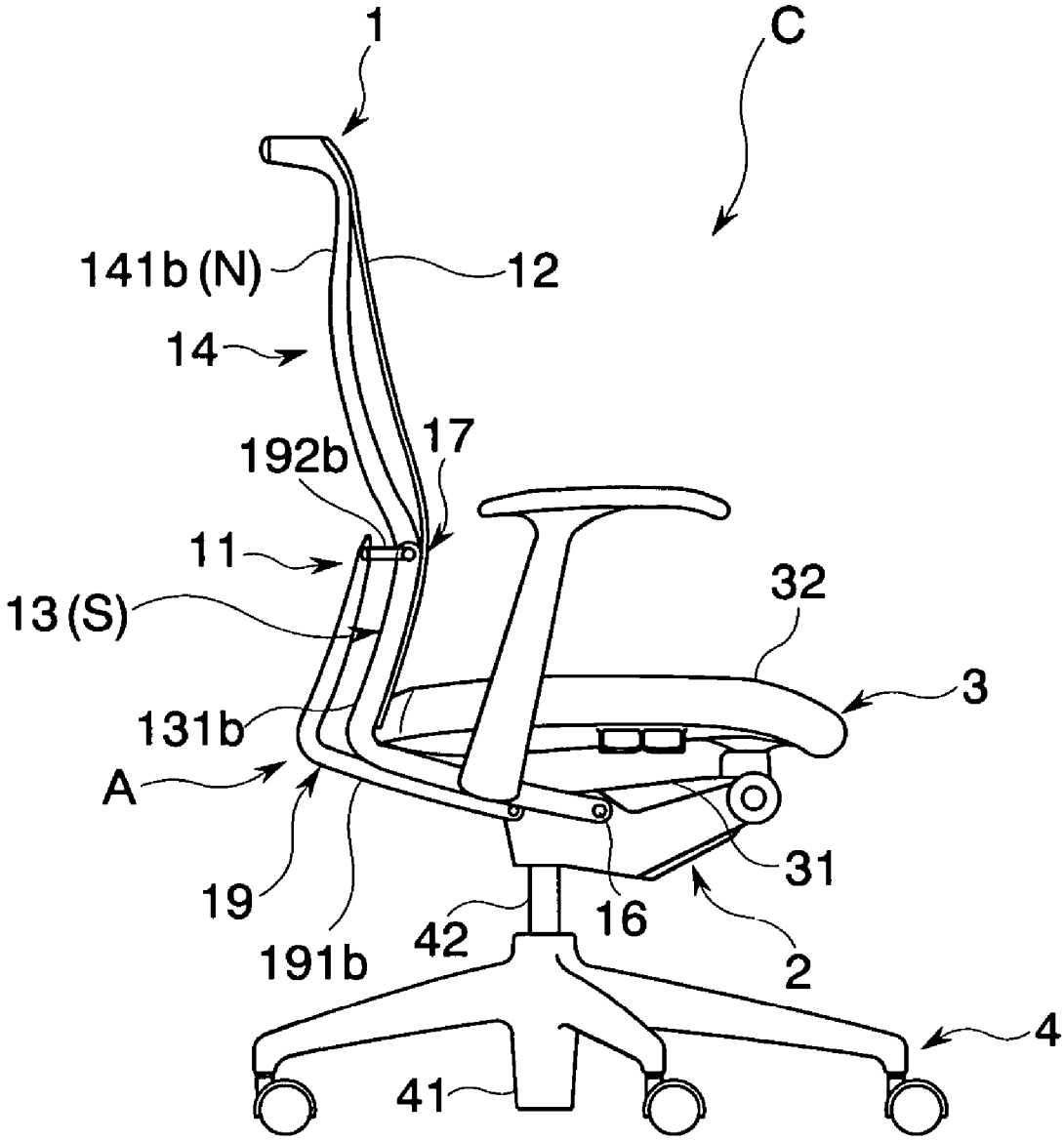
FIG. 1 is a side view showing the chair according to an embodiment of the present invention.

An embodiment of the present invention will now be explained while referring to the drawings.

The chair C according to the present embodiment is comprised, as shown in FIGS. 1 to 6, with a leg body 4, a base 2 supported by the leg body 4, a seat 3 disposed on the base 2, and a backrest 1 pivotally attached to the base 2 through a horizontal shaft 16, wherein synchronous rocking movements are possible in which the seat 3 and the backrest 1 perform inclining movements in a linked manner.

Here, the chair C according to the present embodiment comprises a lower frame portion 13 that is supported in a rockable manner between a standing position (S) and a rearward tilting position (T) with respect to the base 2, and an upper frame portion 14 that is supported in a rockable manner between a normal position (N) and a rear end position (E) with respect to the lower frame portion 13. It is further characterized in that it comprises a movement range setting mechanism A that is capable of changing the movement range of the upper frame portion 14 with respect to the lower frame portion 13 through rocking movements in accordance with a position of the lower frame portion 14 with respect to the base 2 during the rocking movement.

Respective components of the chair C will now be concretely explained.

Figure 2:
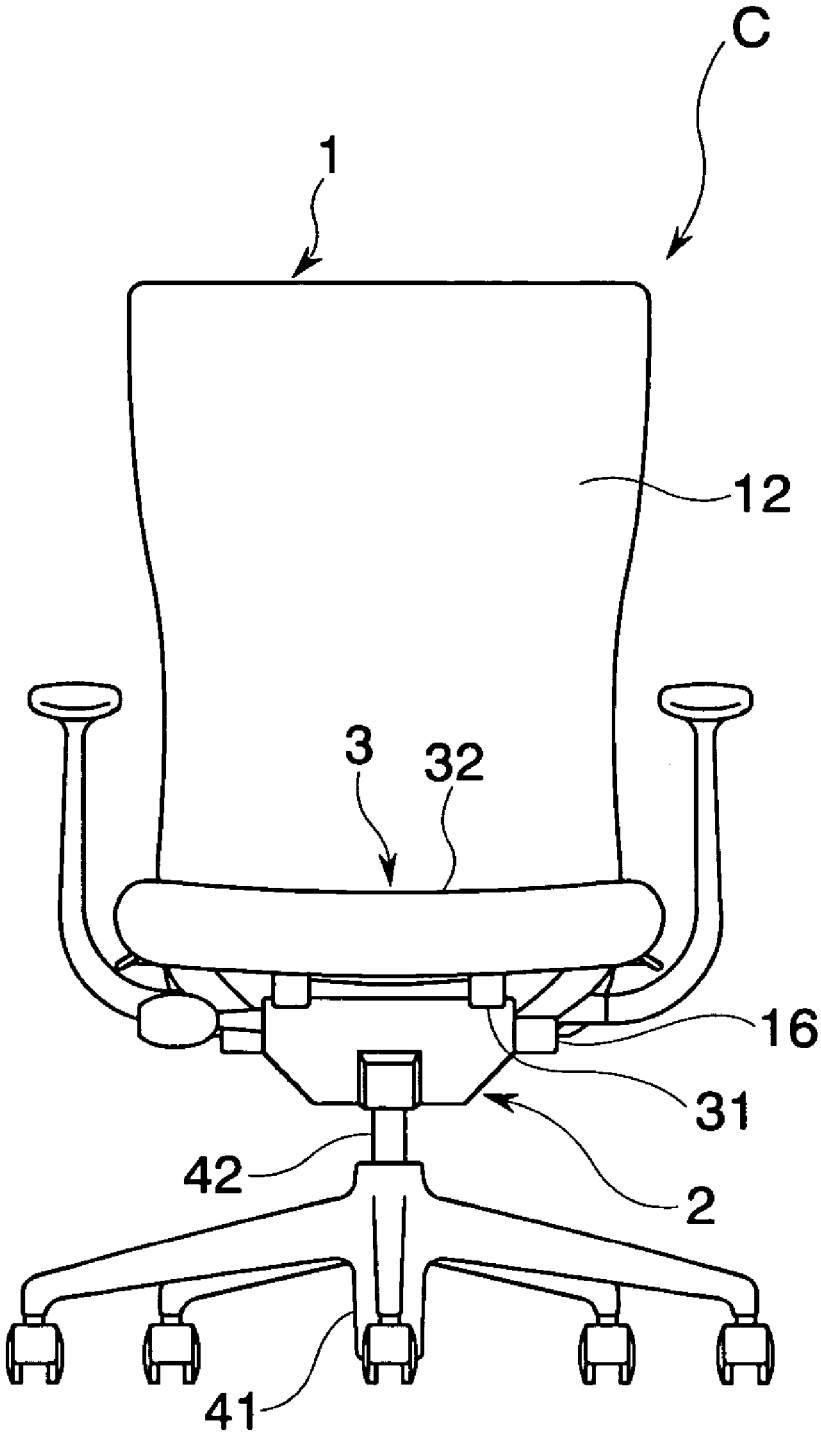
FIG. 2 is a front view of the chair according to the embodiment of the present invention.
Figure 3:
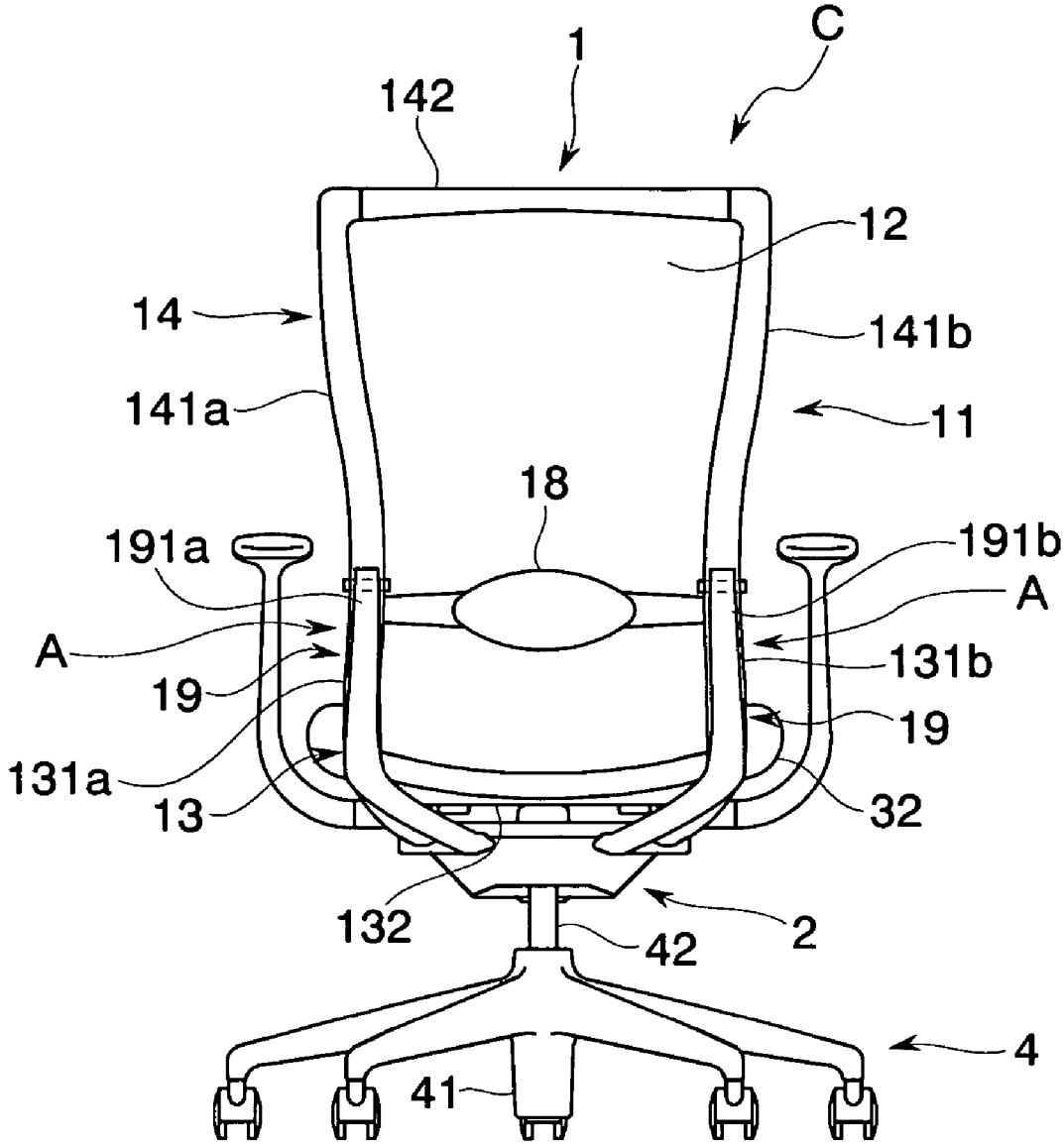
FIG. 3 is a rear view of the chair according to the embodiment of the present invention.
Figure 4:
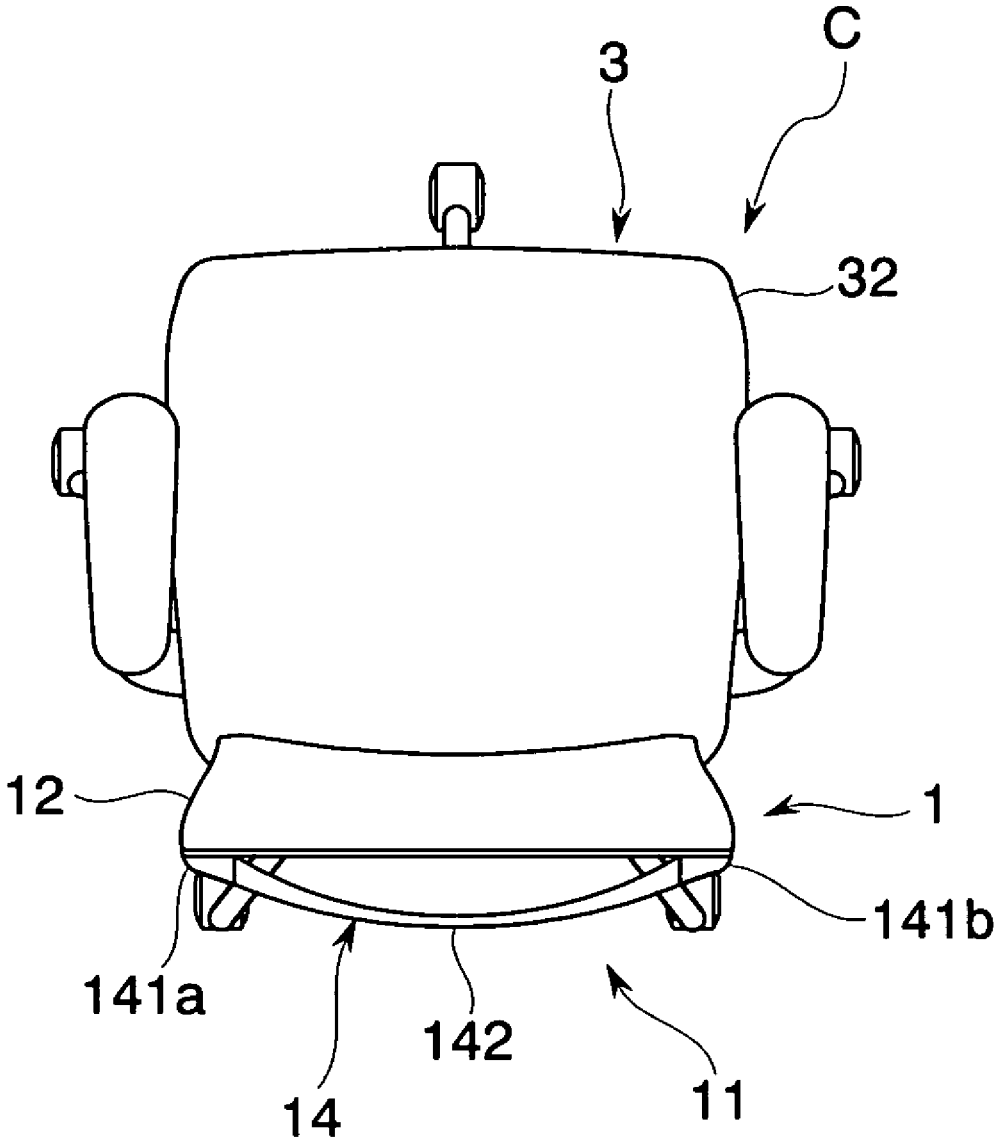
FIG. 4 is a top view of the chair according to the embodiment of the present invention.
Figure 5:
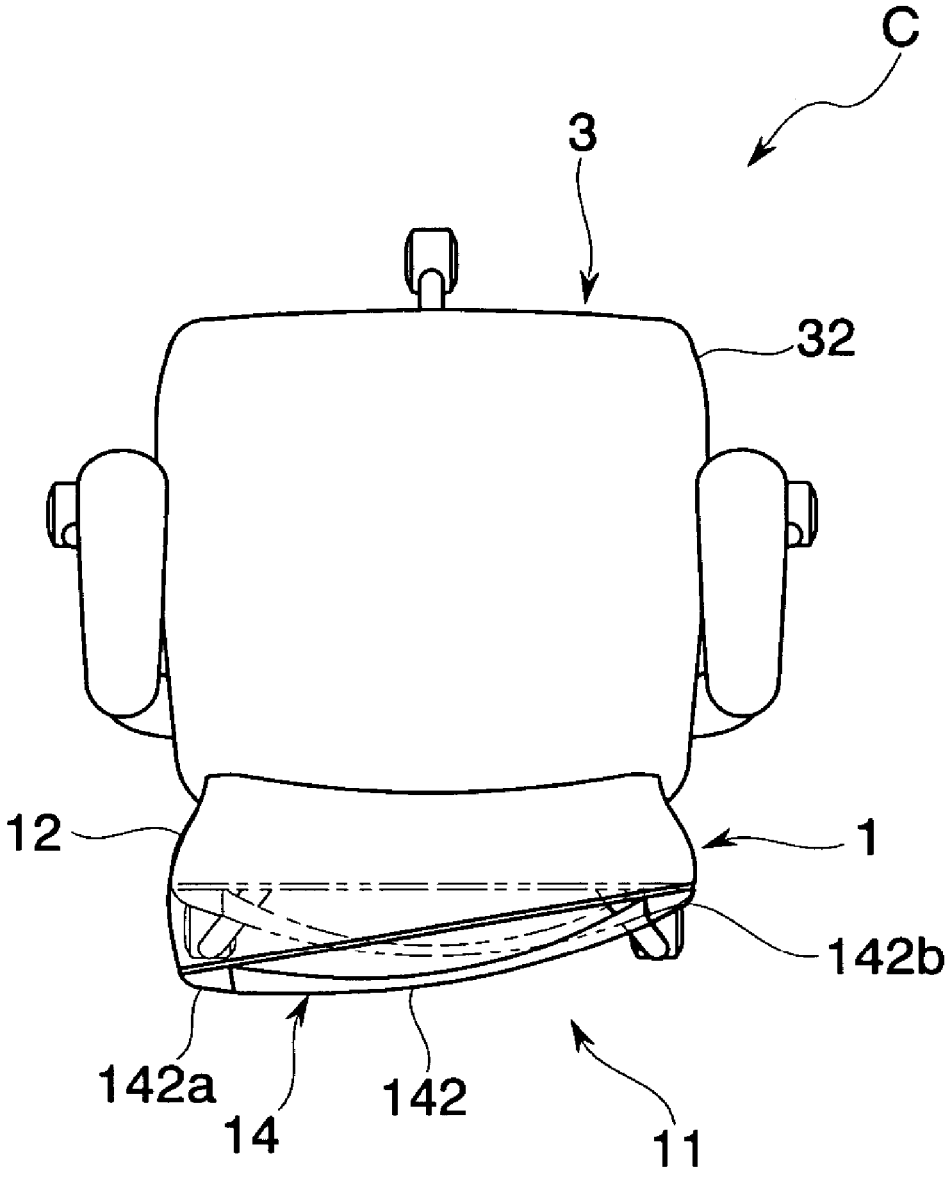
FIG. 5 is a top view showing movements of the chair according to the embodiment of the present invention.

As shown in FIGS. 1 to 3, the leg body 4 comprises a leg wing 41 attached with a plurality of casters and a leg support pillar 42 that rises in a substantially vertical manner from the center of the leg wing 41 wherein the leg support pillar 42 may rise and sink up and down through telescopic movements of a gas spring (not shown) interposingly provided between the leg wing 41 and the leg support pillar 42.

Figure 10:
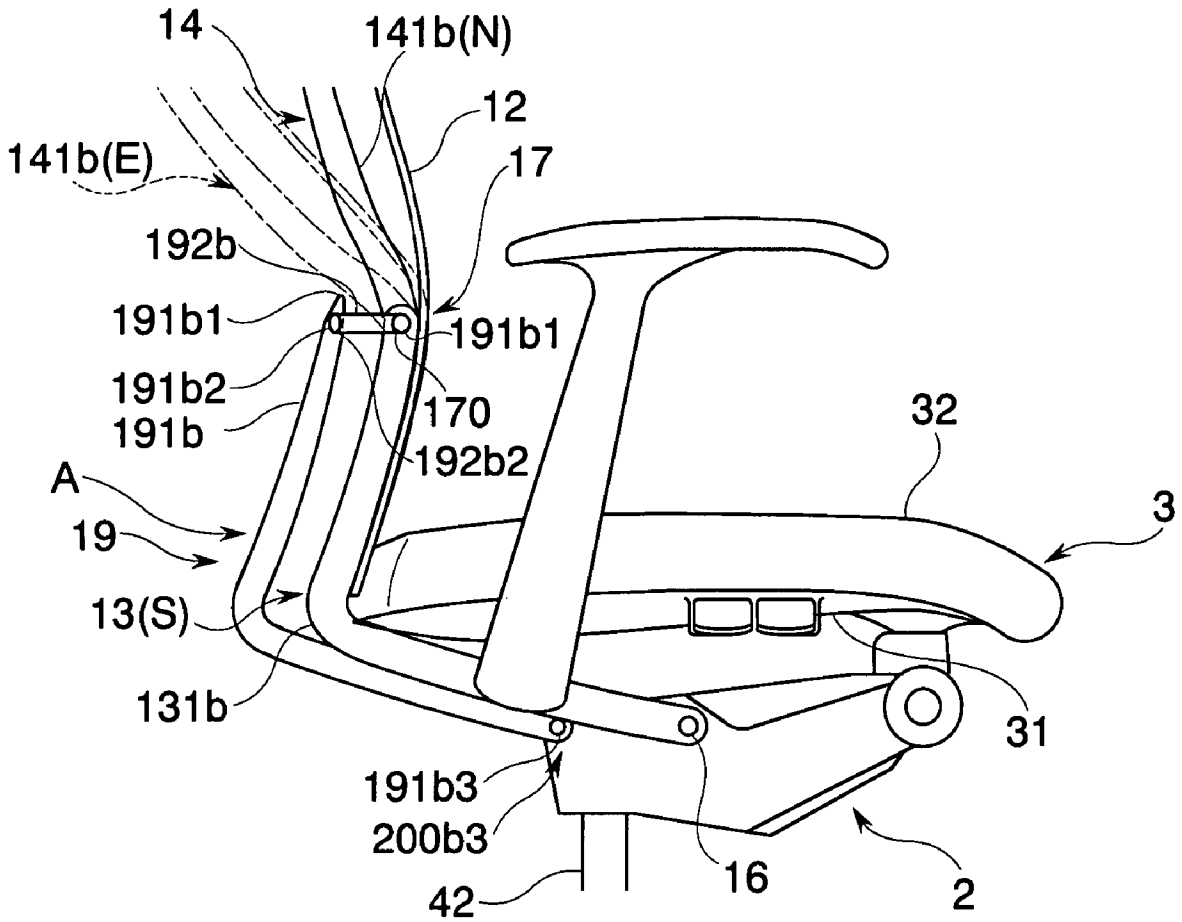
FIG. 10 is a major portion enlarged view corresponding to FIG. 7.
Figure 11:
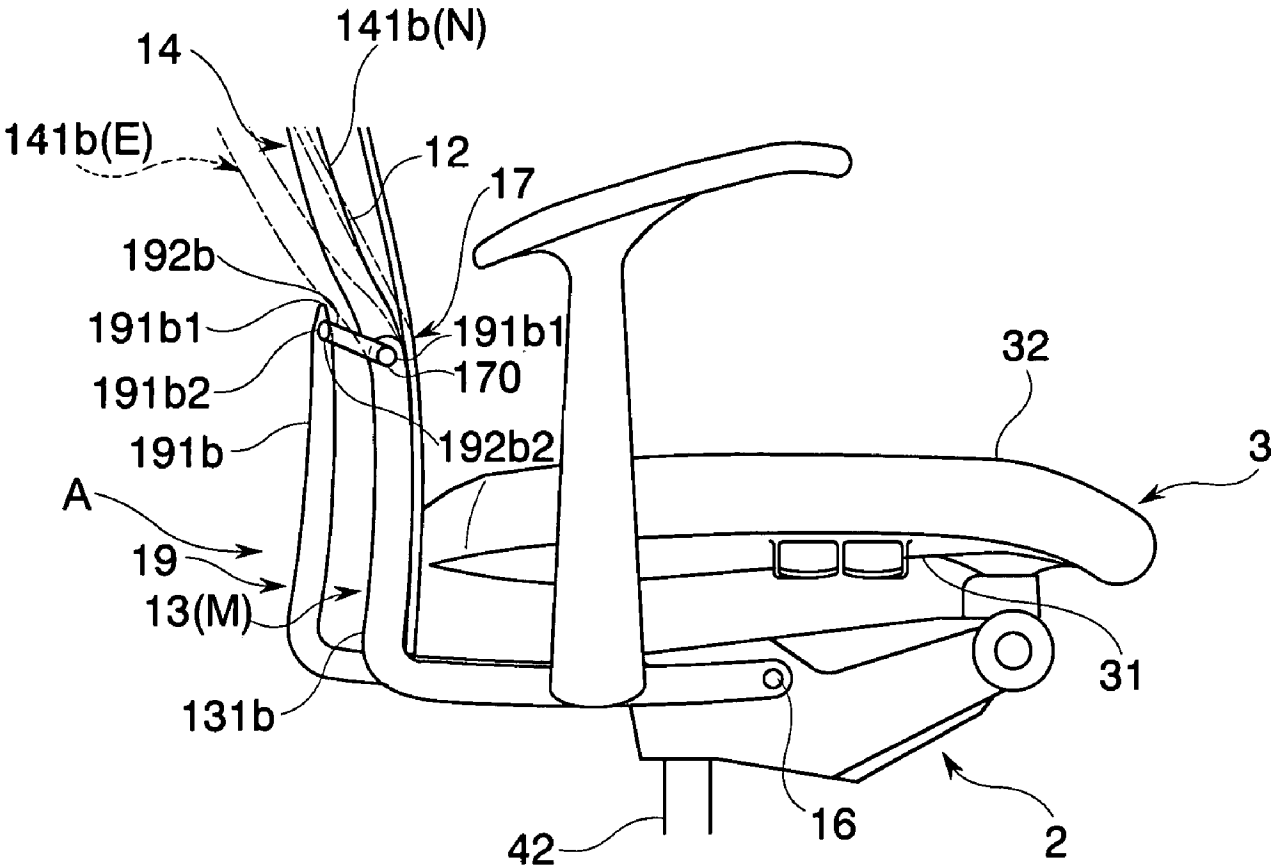
FIG. 11 is a major portion enlarged view corresponding to FIG. 8.
Figure 12:
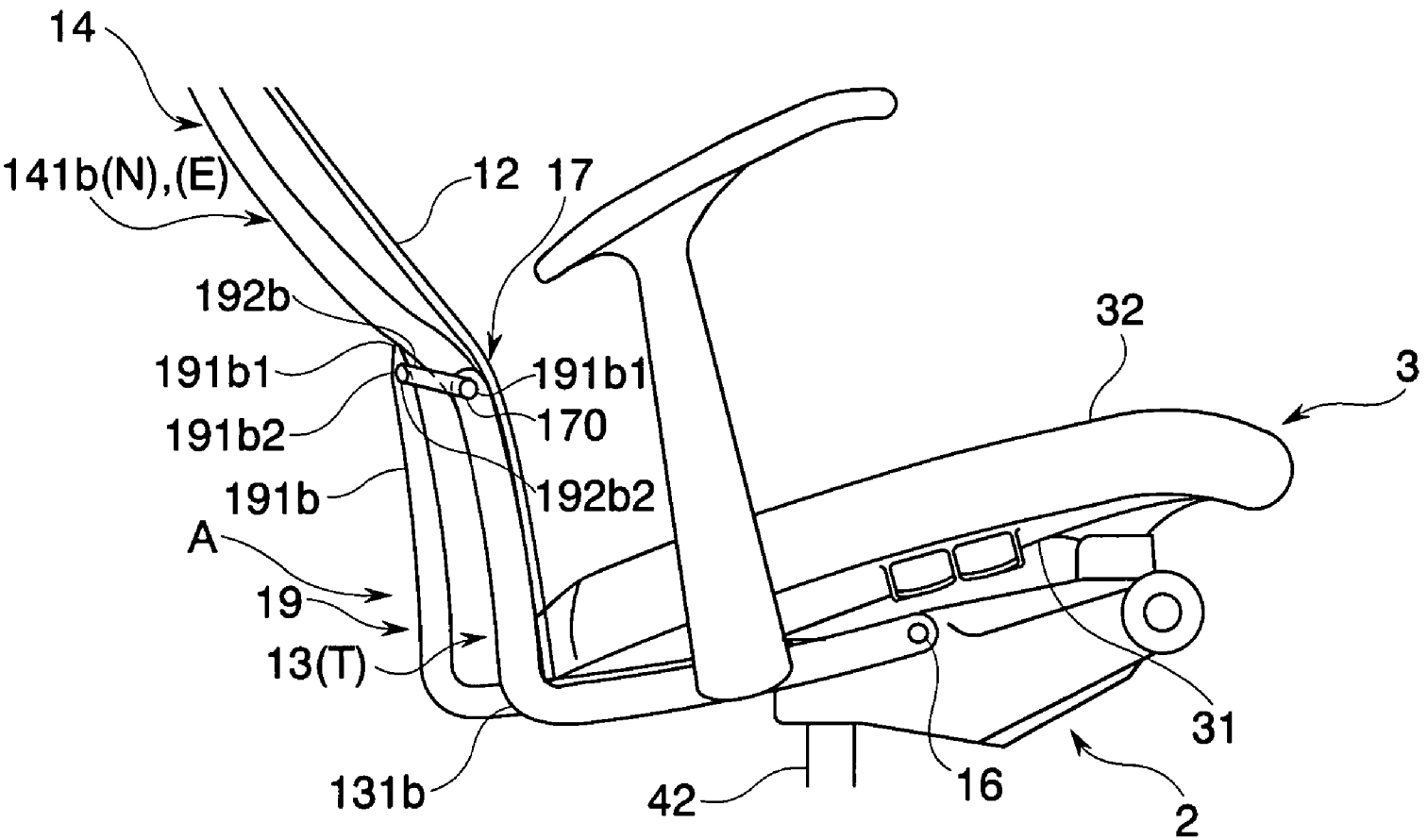
FIG. 12 is a major portion enlarged view corresponding to FIG. 9.

As shown in FIGS. 1 to 3, the base 2 is fixed to an upper end of the leg support pillar 42, and height positions of the seat 3 and the backrest 1 can be adjusted through rising and sinking operations of the leg support pillar 42. The base 2 is provided with, among others, an elastically biasing mechanism (not shown) that biases the backrest 1 that rotates around the horizontal shaft 16 forward, and a fixing mechanism (not shown) that fixes a rocking angle of the backrest 1. There are further provided base end bearings 200*a*3, 200*b*3 for axially fixing base end axes 191*a*3, 191*b*3 of regulating members 191*a*, 191*b* that are to be discussed later (FIGS. 10 to 12). The elastically biasing mechanism serves to elastically bias a back frame 11 upon implementing a coil spring or a gas spring. While the fixing mechanism serves to fix a rocking angle upon selectively engaging, for instance, its claw with anyone of a plurality of stepped concaves formed on the back frame 11 side, where a push-rock type gas spring is used in the elastically biasing mechanism, its valve is actuated for achieving a mode in which telescopic movements of the gas spring are prohibited.

As shown in FIGS. 1 to 6, the seat 3 is arranged by attaching a cushion body 32 that comprises a seat surface onto a seat support 31. The cushion body 32 is of double-layered structure in which, for instance, a urethane cushion material is overlaid onto a double raschel mesh made of synthetic resin, wherein the mesh of the underlying layer absorbs shock while securing suitable elasticity and the urethane cushion material of the upper layer secures stability of appearance. A front end portion of the seat 3 is supported to be slidable in front and rear directions with respect to the base 2 while a rear end portion of the seat 3 is attached to the lower frame portion 13 of the back frame 11 through a hinge (not shown).

As shown in FIGS. 1 to 7, the backrest 1 is arranged in that an upholstery member 12 that comprises a backrest surface is tensioned onto a front surface of the back frame 11. The back frame 11 includes a lower frame portion 13 that is coupled to be rotatable around a horizontal shaft 16 with respect to the base 2 and that is rotatable from a standing position (S) up to a rearward tilting position (T), an upper frame portion 14 that is coupled to an upper end of the lower frame portion 13 and that is rockable from a normal position (N) up to a rear end position (E), and a regulating portion 19 for restricting a movement range of the upper frame portion 14 as will be discussed later.

Figure 6:
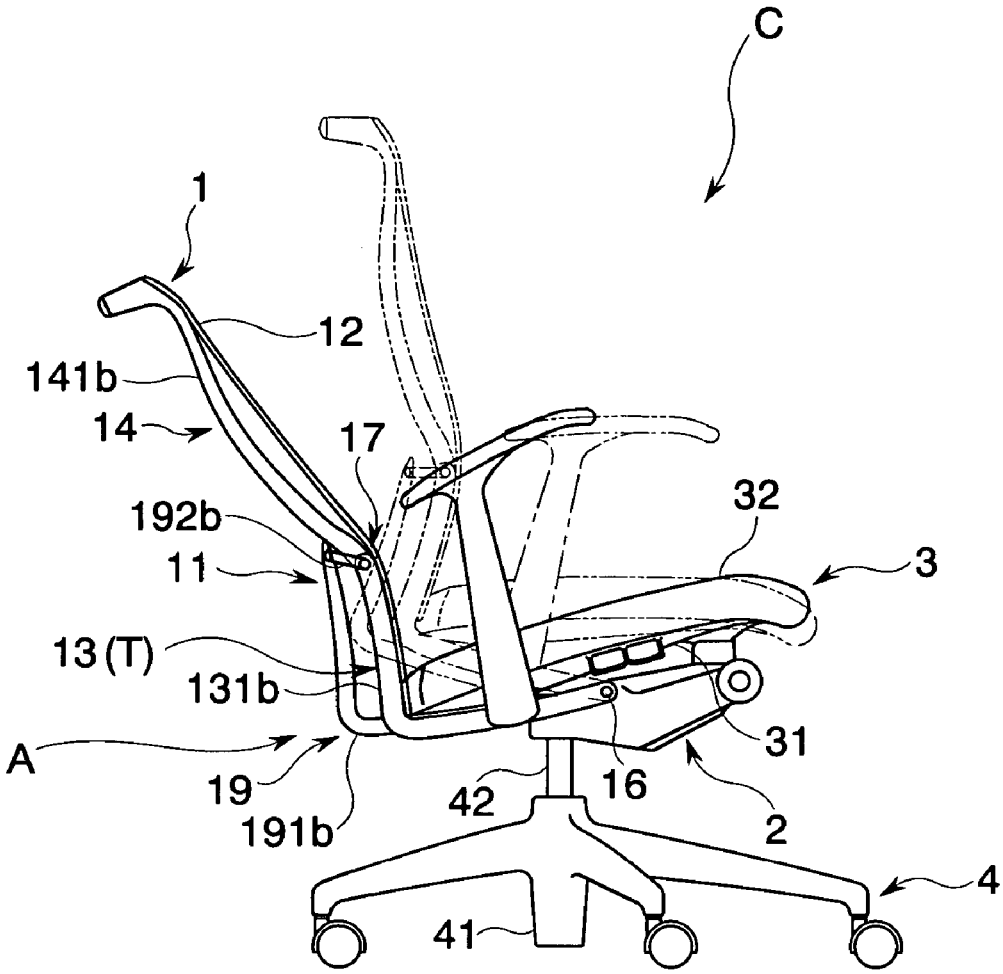
FIG. 6 is a side view showing movements of the chair according to the embodiment of the present invention.

The lower frame portion 13 is arranged in that right and left lower frame elements 131*a*, 131*b* disposed to be apart from each other in a width direction are coupled with each other through a rigid lateral bridging member 132. The lower frame elements 131*a*, 131*b* and the rigid lateral bridging member 132 are, for instance, metallic rigid bodies. The lower frame elements 131*a*, 131*b* extend rearwards from a front end at which the horizontal shaft 16 is positioned, and forms a substantially L-shaped shape upwardly bent at its rear end when seen from a side view. By being axially attached to the base 2 to be rotatable around the horizontal shaft 16, the lower frame portion 13 is arranged to be rockable from the standing position (S) as shown in FIG. 1 up to the rearward tilting position (T) as shown in FIG. 6.

Figure 7:
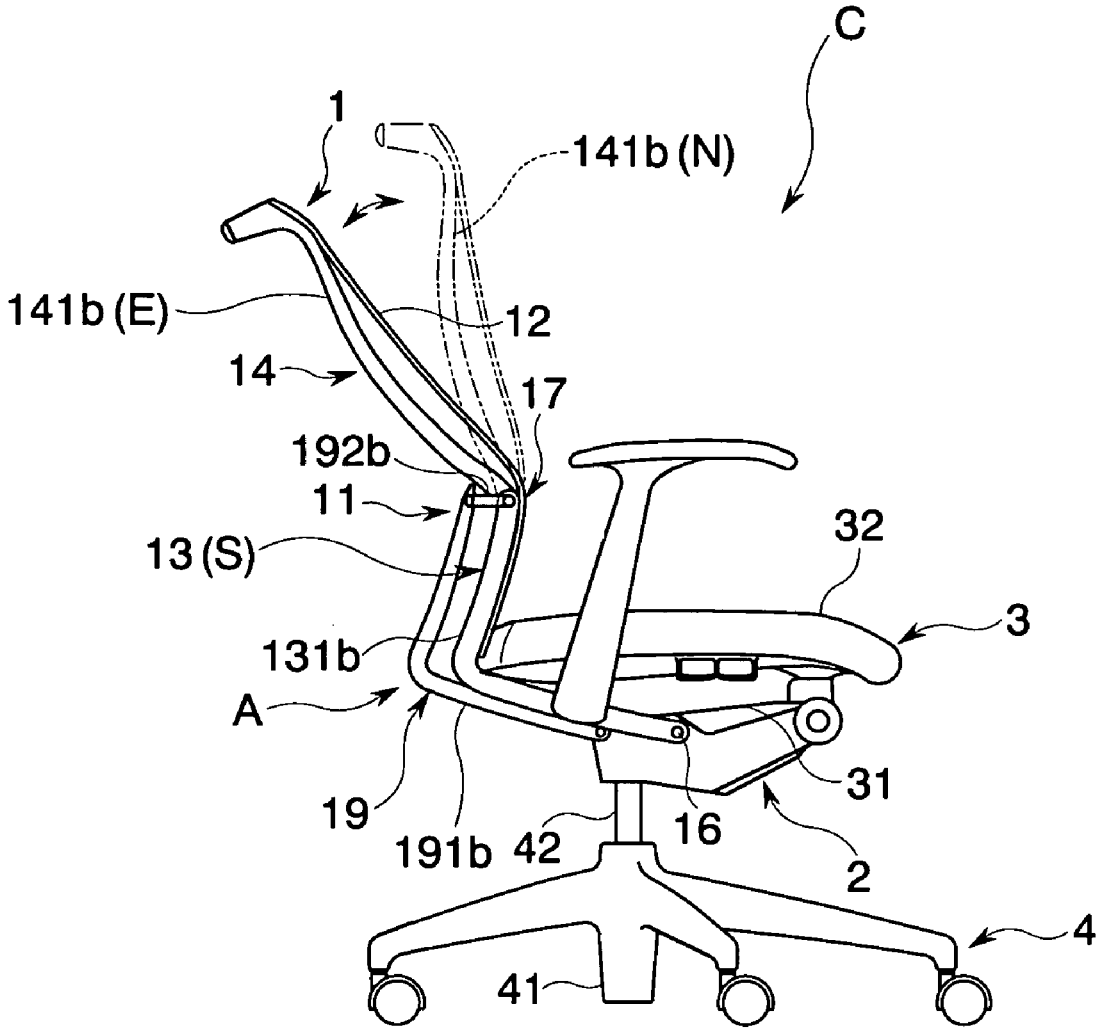
FIG. 7 is an explanatory view showing movements of the chair according to the embodiment of the present invention.

The upper frame portion 14 is arranged in that right and left upper frame elements 141*a*, 141*b* disposed to be apart from each other in a width direction are coupled with each other through an elastic lateral bridging member 142. While the upper frame elements 141*a*, 141*b* are, for instance, metallic rigid bodies, the elastic lateral bridging member 142 is made of an elastic body made, for instance, of resin. The upper frame elements 141*a*, 141*b* assume an arched shape extending upward while gently warping from a lower end at which the hinge 17 is located when seen from a side view so as to slightly dent rearward and swelling frontward again proximate of an upper end thereof. With the right and left upper frame elements 141*a*, 141*b* being axially attached in a rotatable manner through the hinge 17, the upper frame portion 14 is arranged to be rockable from the normal position (N) as shown in FIG. 1 up to the rear end position (E) as shown in FIG. 7 respectively in an independent manner.

In the vicinity of the hinge 17 that mutually connects the lower frame elements 131*a*, 131*b* and the upper frame elements 141*a*, 141*b*, and particularly an area ranging from rear ends up to the vicinity of upper ends of the lower frame elements 131*a*, 131*b* and an area of the vicinity of the lower end of the upper frame elements 141*a*, 141*b*, a warped shape is formed in which the front surface of the frame when seen from a side view is swelling frontward. As already discussed, the front surface of the frame when seen from a side view similarly swells frontward to assume a warped shape also in the vicinity of the upper ends of the upper frame elements 141*a*, 141*b*. The upholstery member 12 is then tensioned so as to bridge over the warped shape of the lower frame elements 131*a*, 131*b* and the upper frame elements 141*a*, 141*b*.

The upholstery member 12 is mainly comprised of an upholstery cloth that exhibits rich stretching properties. The upholstery cloth is obtained by, for instance, weaving elastic thread such as elastomer thread or the like into a double raschel mesh made of synthetic resin, and exhibits both, intensity and cushioning properties. The upholstery cloth differs in its appearance when seen from the front and rear (color, pattern, luster, etc.) An upper side and right and left sides of the upholstery cloth are retained in shape through a backup material (not shown) having a three-sided or four-sided frame-like shape when seen from a front view. The backup material is, for instance, made of a thin plate material made of resin and particularly prevents flexing of the right and left sides of the upholstery cloth towards the inner side and retains the upholstery cloth in a tensioned condition. An upper end portion of the upholstery member 12 is supported by being attached to the right and left upper frame elements 141*a*, 141*b*, and a lower end portion thereof is supported by being attached to the right and left lower frame elements 131*a*, 131*b*. At this time, the backup material exhibits action of a plate spring, and the upholstery cloth is tensioned while pressing the same forward.

It is further possible to bridge a lumber support belt 18 rearward of the upholstery member 12 at a height position corresponding to the waist portion of a seating person. When the seating person is leaning his or her body against the backrest surface, the portion at which the lumber support belt 18 is bridged will not sink backward to exceed a depth corresponding to a length of the lumber support belt 18.

The chair C of the present embodiment is capable of performing synchronous rocking movements in which the seat 3 and the backrest 1 perform inclining movements in a linked manner. More particularly, as shown in FIG. 6, in the synchronous rocking movements, the backrest 1 inclines to the front and back through the entire back frame 11 rotating around the horizontal shaft 16 simultaneously with the rear end portion of the seat 3 rocking up and down in linkage of the back frame 11 and the front end portion of the seat 3 sliding to the backward and forward.

The chair C of the present embodiment further enables movements of displacing only a left half portion of the upper portion of the backrest surface or a right half portion backward in accordance with movements in which a seating person turns back while remaining seated, reaches his or her hand, or twists his or her body so that the chair is arranged to truly follow movements of the upper body of the seating person. The upper frame portion 14 that supports to the upper portion of the backrest surface is arranged, as mentioned above, in that the upper frame elements 141*a*, 141*b* that comprise a pair on the right and left move individually backward and forward. More particularly, the left upper frame element 141*a* is coupled to the left lower frame element 131*a* through the hinge 17 and the right upper frame element 141*b* is coupled to the right lower frame element 131*b* through the hinge 17, and the upper frame elements 141*a*, 141*b* are individually rotatable.

As shown in FIG. 7, when the upper frame elements 141*a*, 141*b* are inclined backward around the hinge 17, the area at which the upholstery member 12 contacts a portion at which the lower frame elements 131*a*, 131*b* and the upper frame elements 141*a*, 141*b* form a warped shape gradually increases and the upholstery cloth extends in vertical directions while increasing in tensile strength.

Figure 8:
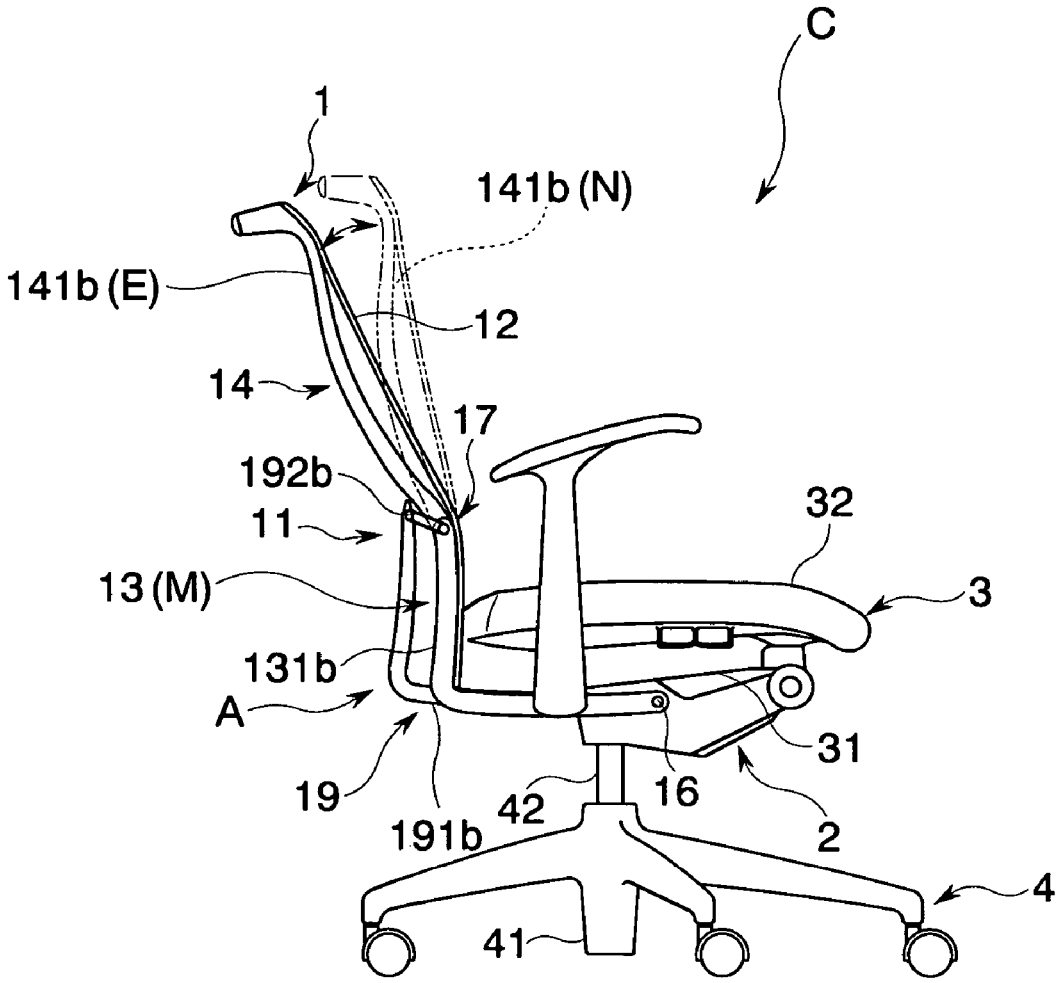
FIG. 8 is an explanatory view showing movements of the chair according to the embodiment of the present invention.
Figure 9:
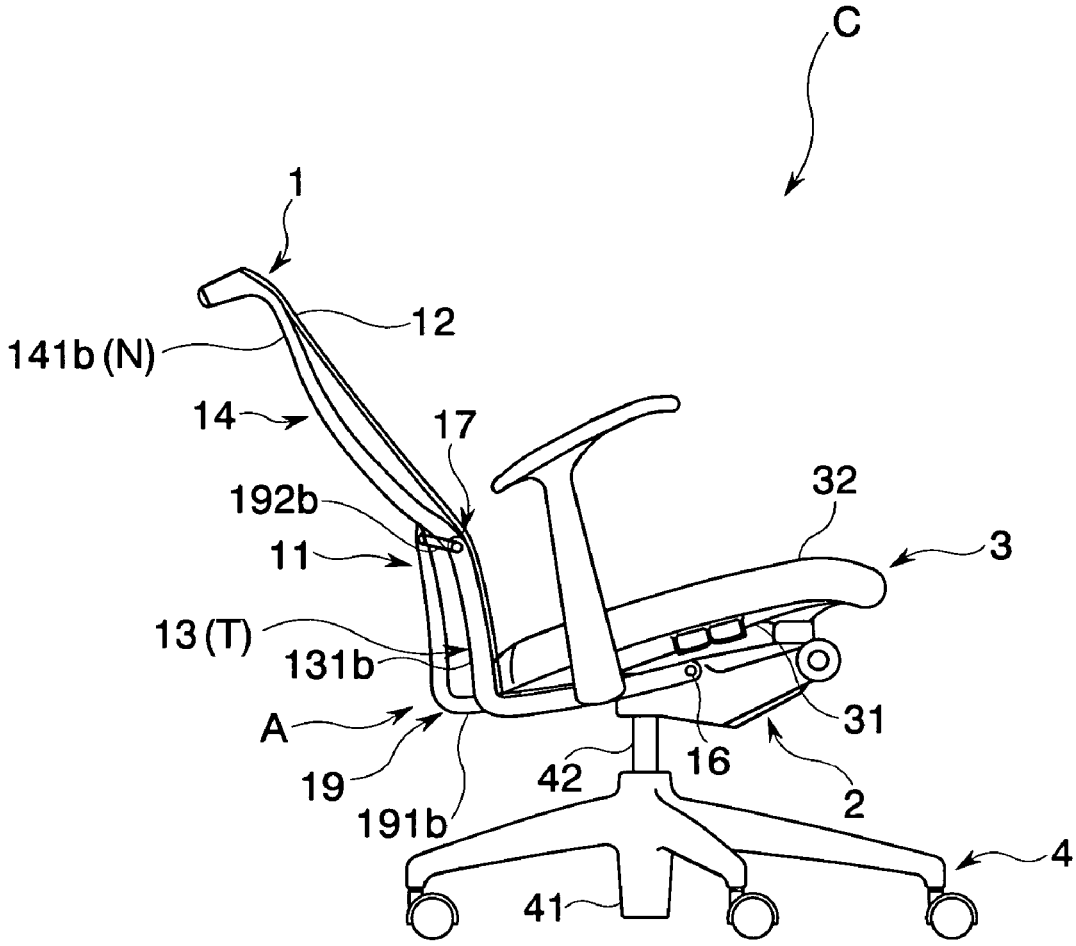
FIG. 9 is an explanatory view showing movements of the chair according to the embodiment of the present invention.

Then, when either one of the upper frame elements 141*a* (141*b*) is displaced in a relatively front and rear direction with respect to the other upper frame element 141*b* (141*a*), the shape of the backrest surface can be three-dimensionally changed as shown in FIGS. 8 and 9. During such movements, the lower frame portion 13 is not necessarily driven. Moreover, since the lower frame elements 131*a*, 131*b* that form a pair on the right and left are rigidly coupled through the rigid lateral bridging member 132, the lower frame elements 131*a*, 131*b* constantly move in an integral manner. Accordingly, a lower portion of the backrest surface, that is, a portion that is located downward of the waist portion of a seating person constantly maintains a certain shape.

When one of the upper frame elements 141*a*, 141*b* moves back and forth relative to the other accompanying movements of a seating person, the distance between the right and left upper frame elements 141*a*, 141*b* increases. At this time, the elastic lateral bridging member 142 elastically deforms to correspond to the increase in distance between both upper frame elements 141*a*, 141*b*. The lateral bridging member 142 of the present embodiment is arranged in that upper end portions of the upper frame elements 141*a*, 141*b* are mutually coupled, and are assembled to form a warped shape that is dent rearward when seen in a planar view. The thickness of the lateral portion and vertical portion of the elastic lateral bridging member 142 becomes gradually thinner in coming closer from both end portions coupled to the upper frame elements 141*a*, 141*b* towards the center in the width direction so that the intermediate portion is relatively made easier to deform rather than both end portions. This is for avoiding a case in which load is focused at the coupling portions of the upper frame elements 141*a*, 141*b* and the elastic lateral bridging member 142. When one of the upper frame elements 141*a*, 141*b* moves relatively backward or forward with respect to the other, the elastic lateral bridging member 142 deforms so as to reduce in radius of curvature such that the distance between both ends is expanded.

In addition thereto, the load of a seating person that the backrest surface receives acts on the upper frame elements 141*a*, 141*b* through the upholstery member 12 and puts load on the hinge 17 by trying to make the upper frame elements 141*a*, 141*b* collapse to the inner side. For the purpose of canceling and reducing such load, the elastic lateral bridging member 142 is assembled in a condition in that it exhibits initial elastic force in which the width between the upper frame elements 141*a*, 141*b* increases.

It is of course possible to make both of the upper frame elements 141*a*, 141*b* on the right and left incline. In such instance, it is, for example, possible to achieve stretching in which the back of a seating person is largely thrown back.

In this manner, the chair C according to the present embodiment comprises a movement range setting mechanism A in which the movement range of the upper frame portion 14 can be changed in accordance with positions of the lower frame portion 13 by the provision of the regulating portion 19 as mentioned above.

As shown in FIGS. 7 to 12, the regulating portion 19 includes regulating members 191*a*, 191*b* and link elements 192*a*, 192*b*. The regulating members 191*a*, 191*b* are arranged in that their lower end portions are axially attached to the base 2 through base end axes 191*a*3, 191*b*3, and in that they extent to face along the lower frame elements 131*a*, 131*b* and upper frame elements 141*a*, 141*b*, which are axially attached to the link elements 192*a*, 192*b* in the vicinity of upper end portions via tip end axes 191*a*2, 191*b*2, to comprise a frame-like shape formed in the form of the letter L when seen from a side view. The upper end of the regulating portion 19 comprises contacting end portions 191*a*1, 191*b*1 that abut the upper frame elements 141*a*, 141*b* so as to determine the rear end position (T) of the upper frame 14 or that prohibit the rocking movement of the upper frame portion 14 itself. The link elements 192*a*, 192*b* are axially attached to a pin 170 of the hinge 17 and the tip end axes 191*a*2, 191*b*2 of the regulating members 191*a*, 191*b* at the one end portions 192*a*1, 192*b*1 and the other end portions 192*a*2, 192*b*2. Through this arrangement, the regulating members 191*a*, 191*b*, the link elements 192*a*, 192*b*, the lower elements 131*a*, 131*b* and the base 2 realize a so-called parallel link mechanism so as to comprise the movement range setting mechanism A.

Changes in movement range of the upper frame portion 14 by the movement range setting mechanism A will now be described in details.

As shown in FIGS. 7 to 9, accompanying the rocking movement of the lower frame portion 13 to the standing position (S) as shown in FIG. 7, to the intermediate position (M) as shown in FIG. 8, and to the rearward tilting position (T) as shown in FIG. 9, respectively, the regulating members 191*a*, 191*b* gradually lift upward to come closer to the normal position (N) of the upper frame portion whereby the movement range from the normal position (N) to the rear end position (E) becomes gradually narrower (FIG. 8) and will finally not be moveable at the rear end position (E) (FIG. 9).

More particularly, as shown in FIGS. 10 to 12 which are enlarged views corresponding to the above FIGS. 7 to 9, accompanying the rocking movement of the lower frame portion 13 to the standing position (S), the intermediate position (M) and the rearward tilting position (T), the contacting end portions 191*a*1, 191*b*1 of the regulating members 191*a*, 191*b* come closer to the upper frame elements 141*a*, 141*b* while tentatively rising up, and with the contacting end portions 191*a*1, 191*b*1 abutting the upper frame elements 141*a*, 141*b*, rocking movements of the upper frame elements 141*a*, 141*b* at the rearward tilting position (T) are prohibited. In other words, when the contacting end portions 191*a*1, 191*b*1 abut the upper frame elements 141*a*, 141*b* at the rearward tilting position (T) of the lower frame portion 13, the normal position (N) and the rear end position (E) of the upper frame elements 141*a*, 141*b* will be positioned at the same position. In this respect, while the hinge 17 also includes a front contacting portion for determining a normal position (N) of the upper frame portion 14, various known arrangements can be employed as the arrangement for regulating movements of the hinge 17 at the normal position (N) so that they will be not discussed in details in the present embodiment.

As explained so far, the chair C according to the present embodiment is arranged that by the provision of the above-mentioned movement range setting mechanism A, the movement range of the upper frame portion 14, especially, the upper frame elements 141*a*, 141*b* can be respectively set to meet the posture of a seating person, and particularly the posture of his or her upper body. More particularly, where the shape of the backrest 1 of the chair C shall follow movements of the upper body of the seating person, the movement range of the upper frame elements 141*a*, 141*b* can be set larger while where the backrest 1 shall support the upper body of the seating person, the movement range of the upper frame elements 141*a*, 141*b* can be set smaller. As a result, a chair C is achieved having a backrest 1 capable of serving two functions, namely the function of following movements of the seating person and the function of supporting the upper body of the seating person according to the wish of the seating person.

Further, since the movement range setting mechanism A is arranged in that the movement range of the upper frame elements 141*a*, 141*b* is respectively set narrower with the lower frame portion 13 coming closer to the rearward tilting position (T), it is possible to arrange the backrest 1 to follow movements so as not to prevent movements of the upper body when a seating person is sitting with his or her upper body upright during work or some other reasons while the upper frame elements 141*a*, 141*b* are arranged to preferably support the upper body of the seating person respectively when the upper body is inclined backward so that the lower frame portion 13 is inclined backward such as in case the seating person is leaning against the backrest 1.

Further, since the movement range setting mechanism A is arranged in that the rear end position (E) of the upper frame is made to come closer to the normal position (N) with the lower frame portion coming closer to the rearward tilting position (T), it is possible to incline the upper body backward in a stable manner when the lower frame portion 13 is inclined backward. Since the movement range setting mechanism A of the present embodiment is arranged in that movements of the upper frame elements 141*a*, 141*b* are prohibited when the lower frame portion 13 is at the rearward tilting position (T), it is possible to preferably support the upper body of a seating person at the rearward tilting position (T).

In the present embodiment, by particularly employing the regulating portion 19, the contacting end portions 191*a*1, 191*b*1 of the regulating members 191*a*, 191*b* are arranged to tentatively abut the normal position (N) of the upper frame elements 141*a*, 141*b* in accordance with rocking movements of backwardly inclining the lower frame portion 13 so that they abut the upper frame elements 141*a*, 141*b* when the upper frame elements 141*a*, 141*b* are located at the rear end position (E) such that movements of the upper frame elements 141*a*, 141*b* are prohibited. In this manner, it is possible to preferably arrange a movement range setting mechanism A capable of setting the movement range of the upper frame elements 141*a*, 141*b* continuously by simply adding two parts such as the regulating members 191*a*, 191*b* and the link elements 192*a*, 192*b*.

By supporting the regulating members 191*a*, 191*b* by the base 2, it is possible to preferably arrange a parallel link mechanism to preferably correspond to movements of the lower frame portion 13.

While an embodiment of the present invention has been explained so far, concrete arrangements of the respective parts are not limited to those of the above-mentioned embodiment alone but may be variously modified without departing from the spirit of the present invention as illustrated in the following modified examples.

First Modified Example

Figure 13:
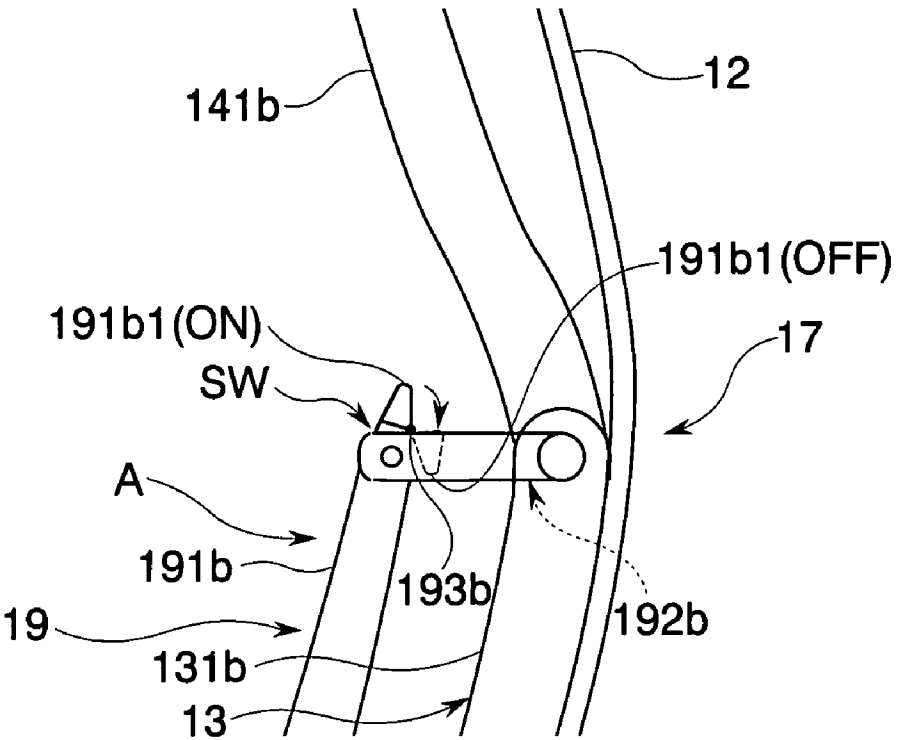
FIG. 13 is a structural explanatory view according to a first modified example of the embodiment of the present invention.

It is, for instance, possible to provide a switching mechanism SW for temporality terminating functions of the above-mentioned movement range setting mechanism A as shown in FIG. 13. More concretely explaining, a folding portion 193*b* is provided proximate of the contacting end portions 191*a*1, 191*b*1 of the regulating members 191*a*, 191*b*, and by suitably rotating the folding portion 193*b*, it is possible to switch between an ON condition (ON) in which the contacting end portions 191*a*1, 191*b*1 may abut the upper frame elements 141*a*, 141*b* and an OFF condition (OFF) in which the butting end portions 191*a*1, 191*b*1 may not abut the upper frame elements 141*a*, 141*b* as indicated by the dotted line.

Figure 14:
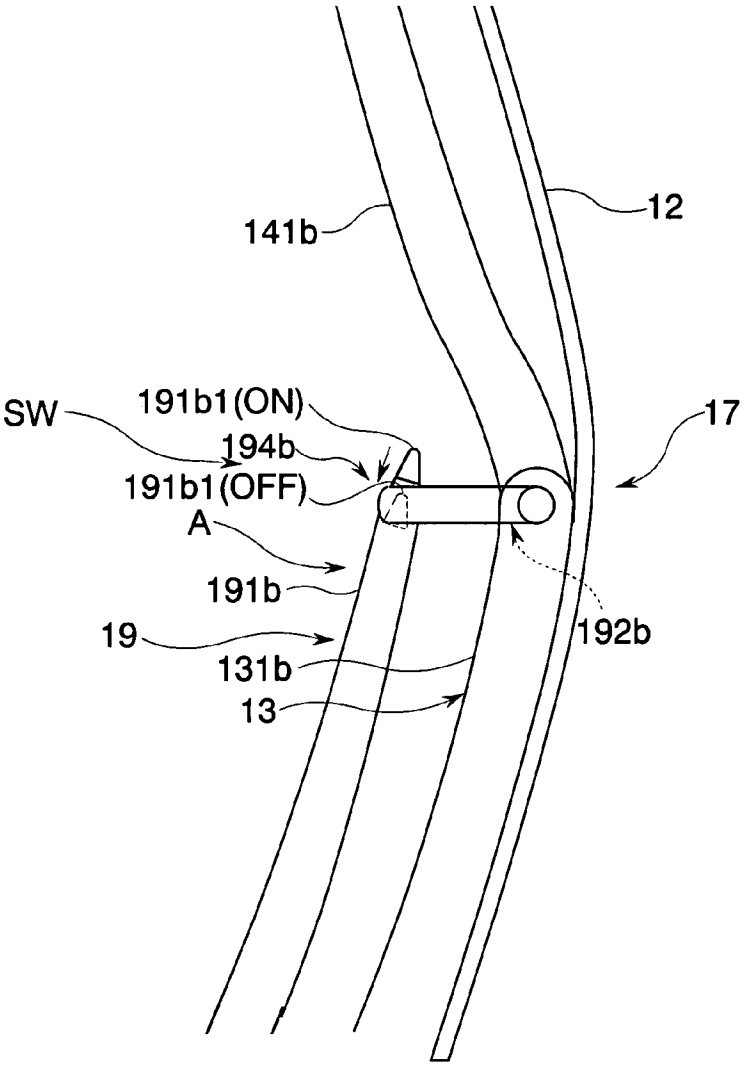
FIG. 14 is a structural explanatory view according to the first modified example of the embodiment of the present invention.

Further, as illustrated in FIG. 14, it is also possible to provide a projecting and sinking regulating portion 194*b* in the vicinity of the contacting end portions 191*a*1, 191*b*1 of the regulating members 191*a*, 191*b*, wherein by suitably operating the projecting and sinking regulating portion 194*b*, it is possible to switch between an ON condition (ON) in which the contacting end portions 191*a*1, 191*b*1 may abut the upper frame elements 141*a*, 141*b* and an OFF condition (OFF) in which the butting end portions 191*a*1, 191*b*1 may not abut the upper frame elements 141*a*, 141*b* as indicated by the dotted line.

With such an arrangement, it is possible to provide an arrangement in which functions of the movement range setting mechanism A can be temporally terminated upon switching settings of the movement range setting mechanism A at the request of a seating person.

Second Modified Example

Figure 15:
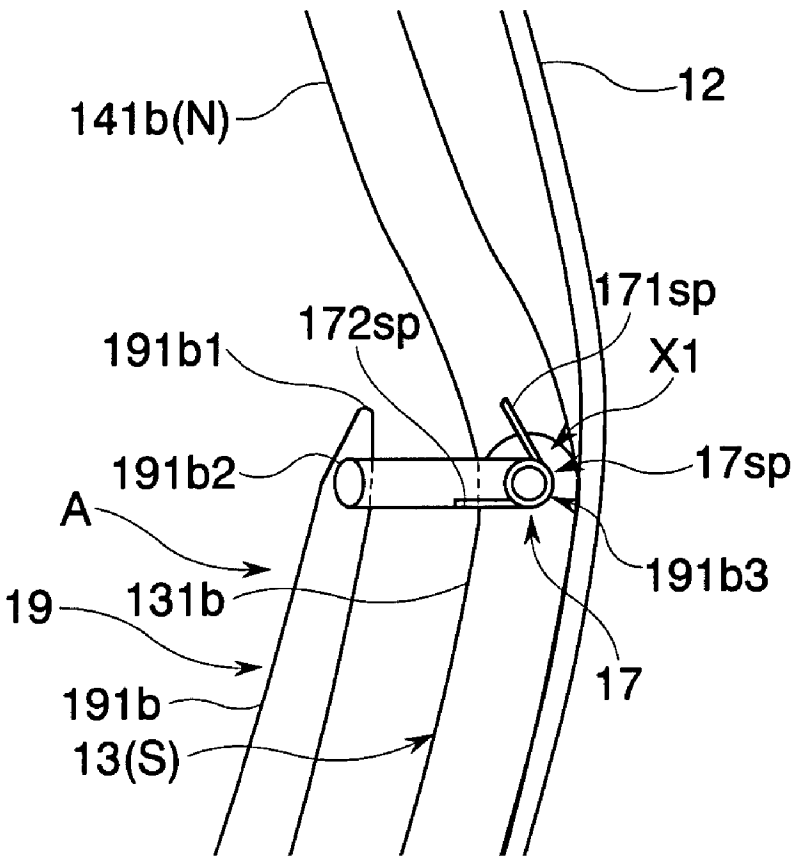
FIG. 15 is a structural explanatory view according to a second modified example of the embodiment of the present invention.
Figure 16:
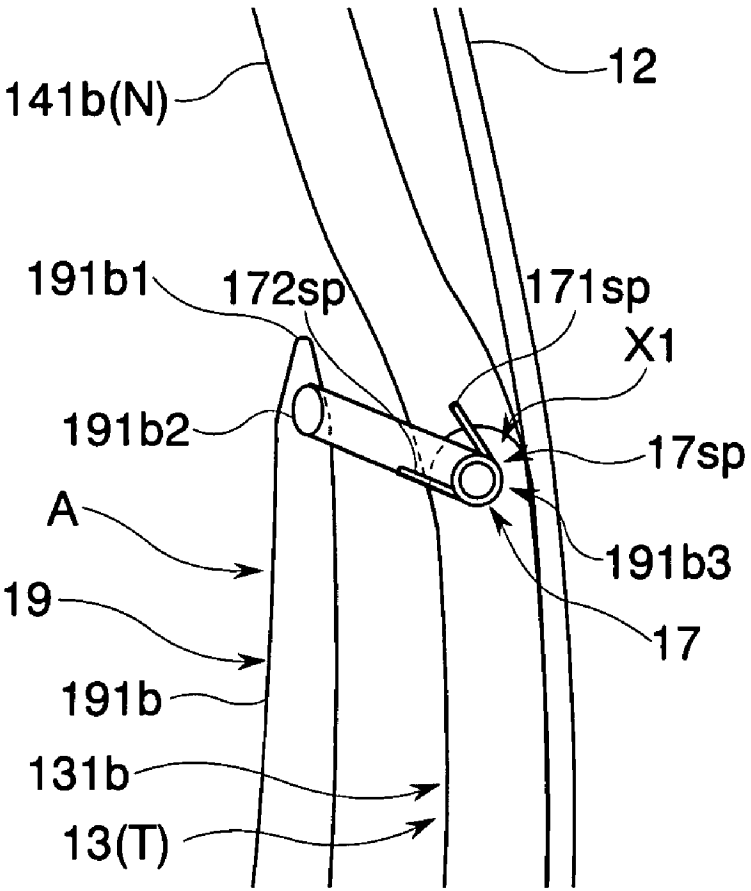
FIG. 16 is a structural explanatory view according to the second modified example of the embodiment of the present invention.

It is further possible to further provide an upper frame portion elastically biasing means X1 that elastically biases the upper frame portion 14 from the rear end position (E) to the normal position (N) as illustrated in FIGS. 15 and 16. More particularly, the upper frame portion elastically biasing means X1 is arranged in that elastically biasing force applied to the upper frame portion 14 is set to be larger with the lower frame portion 14 coming closer to the rearward tilting position (T) In other words, as shown in the drawings, the upper frame portion elastically biasing means X1 is mainly comprised of a torsion coil spring 17*sp* that serves as the elastic member provided between the upper frame portion 14 and the lower frame portion 13, that is, in the vicinity of the hinge 17, wherein one end 171*sp* of the torsion coil spring 17*sp* is fixed to the upper frame elements 141*a*, 141*b* while the other end 172*sp* is fixed to the link elements 192*a*, 192*b*. When the lower frame portion 13 performs rocking movements towards the rearward tilting position (T) starting from the standing position (S) as shown in FIG. 15 towards the intermediate position (M) as shown in FIG. 16, a relative angle between one end 171*sp* and the other end 172*sp* of the torsion coil spring 17*sp* will change in accordance with changes in relative angle of the link element 192*b* with respect to the upper frame element 141*b*. Accompanying this, the elastically biasing force with respect to the upper frame elements 141*a*, 141*b* will become larger since torsion strength of the torsion coil spring 17*sp* will becomes larger.

With such an arrangement, it is possible to achieve an arrangement in which the upper body of a seating person can be supported in a more stable manner accompanying rearward tilting movements of the lower frame portion 13.

Third Modified Example

Figure 17:
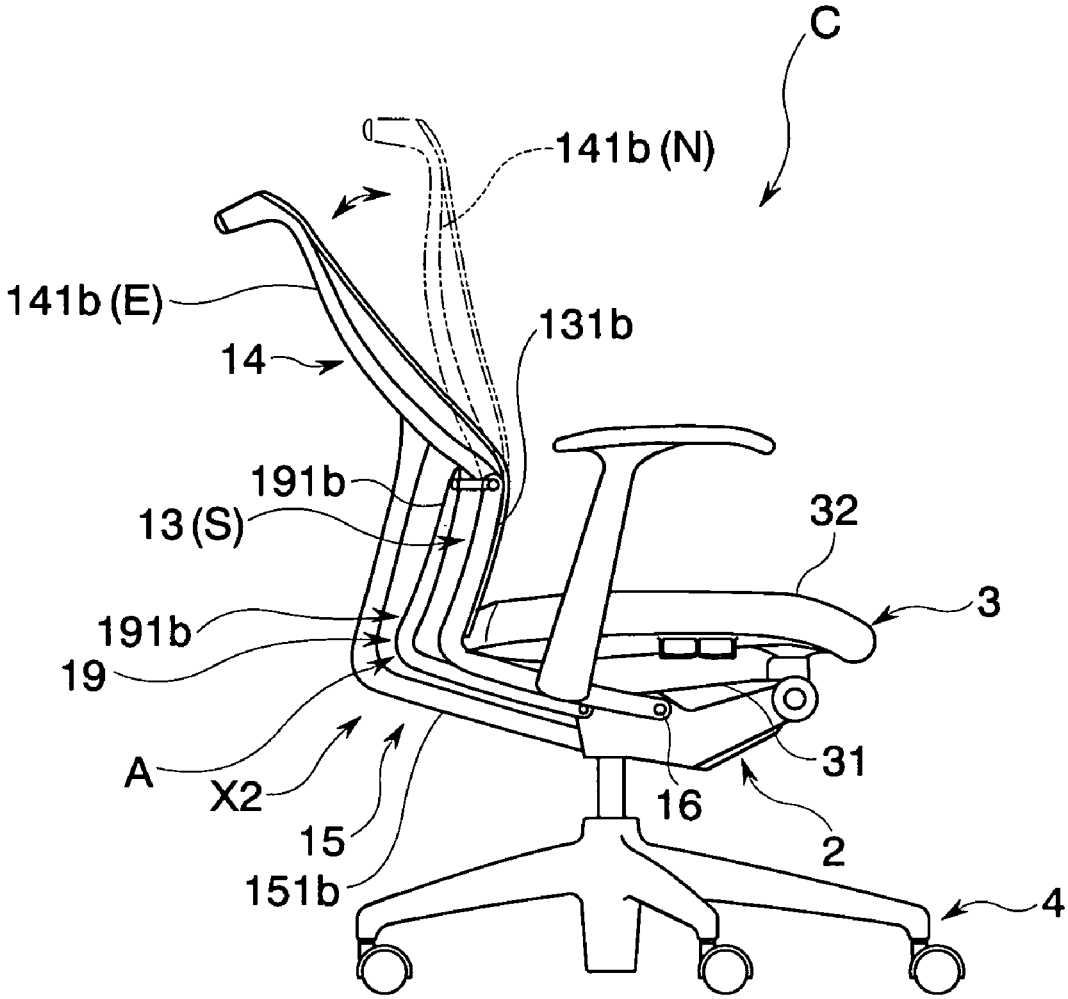
FIG. 17 is a structural explanatory view according to a third modified example of the embodiment of the present invention.
Figure 18:
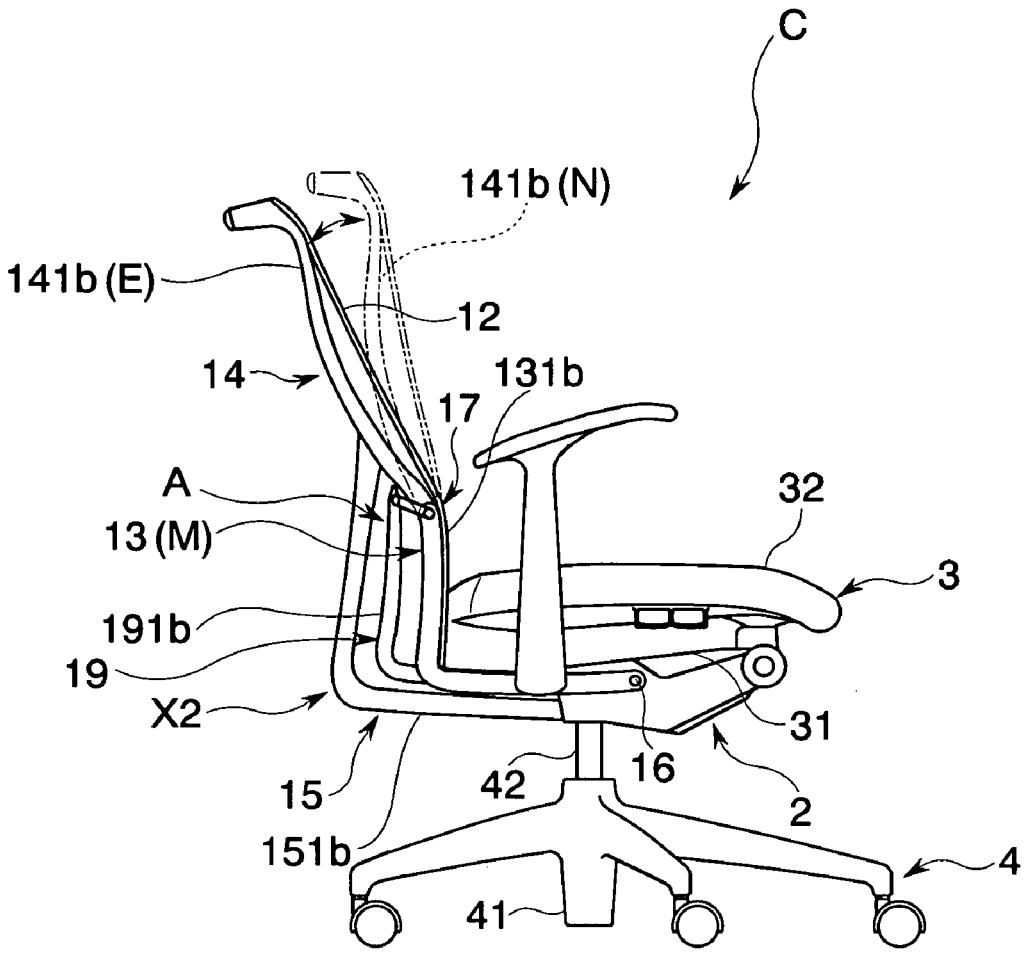
FIG. 18 is a structural explanatory view according to the third modified example of the embodiment of the present invention.

As shown in FIGS. 17 and 18, it is possible to arrange an upper frame portion elastically biasing means X2 as an elastic member by providing a reaction frame portion 15 between the base 2 and the upper frame portion 14.

The reaction frame portion 15 is comprised of a number of reaction frame elements 151*a*, 151*b* corresponding to a number with which each of the upper frame elements 141*a*, 141*b* can be supported. One end portion of the reaction frame elements 151*a*, 151*b* are joined to the rear surface of the upper frame elements 141*a*, 141*b* while the other end is joined to the base 2. The reaction frame elements 151*a*, 151*b* might, for instance, be elastic bodies made of the same material resin as the elastic lateral bridging member 142. In the present embodiment, the reaction frame elements 151*a*, 151*b* are frame-like resin springs having a substantially L-shaped form extending along the lower frame elements 131*a*, 131*b* and the upper frame elements 141*a*, 141*b* when seen from a side view, its width dimension is identical to that of the frame elements 131*a*, 131*b*, 141*a*, 141*b* or somewhat narrower, and its thickness in the front and back as well as in the vertical is thinner than that of the frame elements 131*a*, 131*b*, 141*a*, 141*b* (adding thereto, becoming gradually thinner in coming farther from the end portion at which they are jointed to the frame elements 141*a*, 141*b*). With this arrangement, it is possible to obtain an appearance as if the reaction frame elements 151*a*, 151*b* were a part of the back frame 11, branching from the upper frame elements 141*a*, 141*b*.

With such an arrangement, since the distance between the frame portion 14 and the base 2 becomes smaller accompanying the rearward tilting movement of the lower frame portion 13 from the standing position (S) to the rearward tilting position (T), the reaction frame portion 15 will increase a pressurization with respect to the upper frame portion 14 from the condition as shown in FIG. 17 to the condition as shown in FIG. 18. In this manner, it is possible to realize an arrangement in which the elastically biasing force respect to the upper frame portion 14 is increased accompanying the rearward tilting movement, that is, rocking movement of the lower frame portion 13 by simply mounting the reaction frame elements 151*a*, 151*b*. Moreover, by employing reaction frame elements 151*a*, 151*b* which are frame-like springs, elastically biasing force will be preferably exhibited also in case they are provided between the separated base 2 and the upper frame elements 141*a*, 141*b* through the lower frame portion 13 as shown in the drawings.

While embodiments of the present invention have been explained so far, concrete arrangements of the respective parts are not limited to those of the above-mentioned embodiments alone but may be variously modified without departing from the spirit of the present invention.

For instance, it is possible to employ an arrangement in which the movement range of the upper frame portion becomes larger with the lower frame portion inclining backward to the rearward tilting position. Further, as for the position of the lower frame at which movements of the upper frame portion is prohibited, it is possible to employ an aspect in which movements of the upper frame when the position of the lower frame portion is at any position in the course of reaching from a slightly rearward tilting position from the standing position up to the rearward tilting position, is prohibited.

Other concrete arrangements of respective parts are not limited to those of the above embodiments either, and they may be variously modified without parting from the spirit and scope of the present invention.

What is claimed is:

1. A chair comprising at least a leg body, a base supported by the leg body, and a back frame supported by the base, the back frame comprising a lower frame portion that is supported configured to be rockable between a standing position and a rearward tilting position with respect to the base and an upper frame portion that is supported configured to be rockable between a normal position and a rear end position with respect to the lower frame portion, wherein the chair is comprised with a movement range setting mechanism with which a movement range through a rocking movement of the upper frame portion with respect to the lower frame portion is made changeable in accordance with the position of the lower frame portion with respect to the base during the rocking movement, wherein the movement range setting mechanism is arranged in that the movement range of the upper frame portion is set to become narrower in accordance with the lower frame portion approaching the rearward tilting position.

2. The chair according to claim 1, wherein the movement range setting mechanism is arranged in that the rear end position of the upper frame portion is made to approach the normal position in accordance with the lower frame portion approaching the rearward tilting position.

3. The chair according to claim 2, wherein a regulating member, which prohibits movement of the upper frame portion upon abutting the upper frame portion when the upper frame portion is positioned at the rear end position, is arranged to make the upper frame portion tentatively approach the normal position in accordance with the rearward tilting movement of the lower frame portion.

4. The chair as claimed in claim 3, wherein the regulating member is supported by the base.

5. The chair according to claim 2, wherein the movement range setting mechanism prohibits movement of the upper frame portion at any position of the lower frame portion during which it is backwardly inclining from the standing position to the rearward tilting position.

6. The chair as claimed in claim 2, further comprising an upper frame portion elastically biasing means that elastically biases the upper frame from the rear end position to the normal position, wherein elastically biasing force of the upper frame portion elastically biasing means is set to be larger with the lower frame portion coming closer to the rearward tilting position.

7. The chair according to claim 1, wherein the movement range setting mechanism prohibits movement of the upper frame portion with respect to the lower frame portion while it is backwardly inclining from the standing position to the rearward tilting position.

8. The chair as claimed in claim 7, further comprising an upper frame portion elastically biasing means that elastically biases the upper frame from the rear end position to the normal position, wherein elastically biasing force of the upper frame portion elastically biasing means is set to be larger with the lower frame portion coming closer to the rearward tilting position.

9. The chair according to claim 7, wherein a regulating member, which prohibits movement of the upper frame portion upon abutting the upper frame portion when the upper frame portion is positioned at the rear end position, is provided, and wherein the regulating member is made to abut the upper frame portion at any position of the lower frame portion during which it is backwardly inclining from the standing position to the rearward tilting position.

10. The chair as claimed in claim 9, wherein the regulating member is supported by the base.

11. The chair as claimed in claim 1, further comprising an upper frame portion elastically biasing means that elastically biases the upper frame from the rear end position to the normal position, wherein elastically biasing force of the upper frame portion elastically biasing means is set to be larger with the lower frame portion coming closer to the rearward tilting position.

12. The chair as claimed in claim 11, wherein the upper frame portion elastically biasing means is comprised by an elastic member provided between the upper frame portion and the lower frame portion.

13. The chair as claimed in claim 12, wherein the elastic member is comprised by a frame-like spring.

14. The chair as claimed in claim 11, wherein the upper frame portion elastically biasing means is comprised by an elastic member provided between the base and the upper frame portion.

15. The chair as claimed in claim 14, wherein the elastic member is comprised by a frame-like spring.

16. The chair as claimed in claim 1, comprising a switching mechanism for temporally terminating functions of the movement range setting mechanism.

17. The chair as claimed in claim 1, wherein the upper frame portion includes a pair of upper frame elements disposed on the right and left, this pair of upper frame elements being supported configured to be rockable-with respect to the lower frame portion in a mutually independent manner between a normal position and a rear end position.

18. The chair as claimed in claim 1, comprising a switching mechanism for temporally terminating functions of the movement range setting mechanism.

19. The chair as claimed in claim 1, wherein the upper frame portion includes a pair of upper frame elements disposed on the right and left, this pair of upper frame elements being supported configured to be rockable with respect to the lower frame portion in a mutually independent manner between the normal position and the rear end position.

20. The chair as claimed in claim 1, wherein the upper frame portion is independently movable to the lower frame portion.

* * * * *